US005294863A

United States Patent [19]

Geboers et al.

[11] Patent Number: 5,294,863

[45] Date of Patent: Mar. 15, 1994

[54] LAMP/REFLECTOR UNIT WITH IMPROVED MOUNTING MEANS

[75] Inventors: Jaak M. J. Geboers, Aachen, Fed. Rep. of Germany; Josephus F. Rijckaert, Eindhoven, Netherlands

[73] Assignee: U.S. Philips Corporation, New York, N.Y.

[21] Appl. No.: 422,471

[22] Filed: Oct. 17, 1989

[30] Foreign Application Priority Data

Oct. 18, 1988 [NL] Netherlands ..... 8802557
Feb. 6, 1989 [NL] Netherlands ..... 8900281

[51] Int. Cl.[5] ..... H01K 1/46
[52] U.S. Cl. ..... 313/318; 313/113
[58] Field of Search ..... 313/113, 315, 318; 362/257, 267, 296, 310

[56] References Cited

U.S. PATENT DOCUMENTS 4,310,772 1/1982 Tyler et al. ..... 313/318 X
4,622,486 11/1986 Endo ..... 313/318 X
4,849,670 7/1989 Hellwig et al. ..... 313/318

*Primary Examiner*—Donald J. Yusko
*Assistant Examiner*—Brian Zimmerman
*Attorney, Agent, or Firm*—Robert J. Kraus

[57] ABSTRACT

The lamp/reflector unit has a reflector body (1) provided with a neck-shaped portion (4) with relief (6). An electric lamp (7) provided with contact pins (8) is mounted in the reflector body (1). The neck-shaped portion (4) has a separate first part (9), which extends from the free end (5) of the neck-shaped portion (4) to beyond the relief (6), and a second part (10), which is integral with the reflector body (1) and which lies at least in part within the first part (9). The unit has a simple and rigid construction.

11 Claims, 1 Drawing Sheet

LAMP/REFLECTOR UNIT WITH IMPROVED MOUNTING MEANS

BACKGROUND OF THE INVENTION

The invention relates to a lamp/reflector unit comprising a reflector body provided with a concave reflecting surface having an optical axis, a neck-shaped portion at the reflector body around the optical axis, this neck-shaped portion having a free end and being provided at its outer surface with a relief extending cross to the optical axis, an electric lamp provided with contact pins, which lamp is mounted in the reflector body, while its contact pins project outwards at the free end of the neck-shaped portion. Such a unit is known from GB 2 153 986-A.

Lamp/reflector units, which were originally intended for colour slide projection and to be held in this case at the edge of the reflector body lying on its largest diameter, are now also used to obtain decorative illumination. The units are then mostly held at the contact pins. In order to permit mounting of a reflector unit in a holder in a more reliable manner than when using the clamping force of electrical connection terminals on the contact pins of a unit, the unit according to the aforementioned GB 2 153 986-A has a relief at the surface of the neck-shaped portion. Clamping members at a holder for the unit can cooperate with this relief and can ensure that the unit is fixed. In order that the reflector body with the neck-shaped portion can be formed in an inexpensive indivisible mould, according to the aforementioned Application a reflector body is manufactured having a neck-shaped portion without a relief, is manufactured and it is not until then that the relief is provided by grinding one or more grooves in the neck-shaped portion.

A disadvantage of this known unit is that a groove thus obtained leads especially with the use of glass as construction material to a mechanical weakening of the neck-shaped portion, as a result of which rupture can occur. Another disadvantage with the use of glass is that there is too much spread with respect to the dimensions of the neck-shaped portion to guarantee a good retention of the unit by a holder.

SUMMARY OF THE INVENTION

It is an object of the invention to provide a unit of the kind described in the opening paragraph, which has a simple and rigid construction and allows a high accuracy to size.

According to the invention, this object is achieved in that the neck-shaped portion has a first separate part, which extends from the free end to beyond the relief, and a second part, which is integral with the reflector body, and which lies at least in part within the first part.

The construction of the unit according to the invention allows the choice between reliefs of one or more grooves, one or more ribs and combinations thereof.

The first part of the neck-shaped portion may be secured to the second part, for example, by means of a bonding compound, like glue. It is easy to join together the lamp, the reflector body and the first part of the neck-shaped portion with cement, for example lamp cement. The first part may consist of synthetic material, for example of a thermosetting synthetic material, or of metal. An advantage of this is that a high accuracy to size can be achieved with these materials. A metal part has the favourable effect that heat developed by the lamp can be satisfactorily dissipated to the holder of the unit. Another advantage of a metal part is that it can be readily manufactured from sheet metal.

In an advantageous embodiment the metal first part consists of a tube bent from sheet metal, having a seam and a dovetail closure.

It is advantageous when the first part of the neck-shaped portion also has a relief, which extends in the direction of the optical axis. Thus, it can be prevented that a unit is arranged in a different holder, for example having a different electric voltage, from that for which the unit is intended. It is advantageous, in the case of a neck-shaped portion having a rectangular cross-section, to provide the relief extending in the direction of the optical axis at a corner of the rectangular cross-section. The relief may be obtained in that case by folding the metal tube inward from a lateral incision up to the free tube end.

The first part of the neck-shaped portion can overlap in part the second part of the neck-shaped portion, for example on two opposite sides of said second part or along its entire periphery. An overlap along the entire periphery lends a great mechanical strength to the assembly. It can be useful for easily assembling the unit if the second part of the neck-shaped portion has projections, against which the first part is arrested, for example at the narrow sides of a first part having a rectangular cross-section.

At the free end of the neck-shaped portion, the first part may have inwardly bent tags, which render the unit self-centring and facilitate its insertion into a lampholder.

In spite of a relief of ribs, grooves or ribs and grooves, the unit can be used in a conventional holder without fixing means if in a particular embodiment the first part of the neck-shaped portion has transverse dimensions which are at most equal to the transverse dimensions of the second part of the neck-shaped portion, or, in another embodiment, if the transverse dimensions, in as far as they will be inside a lampholder, are at most equal to those of conventional units.

The construction of the lamp/reflector unit has the advantage that the lamp can be easily retained by its contact pins if a bonding compound is provided in the second part of the neck-shaped portion of the reflector body in order to fix the lamp in the correct position in the reflector body. Subsequently, the first part of the neck-shaped portion can be united with the sub-assembly thus obtained.

BRIEF DESCRIPTION OF THE DRAWING

Embodiments of the lamp/reflector unit according to the invention are shown in the drawing.

In the drawing.

DESCRIPTION OF PREFERRED EMBODIMENTS

Figure 1:
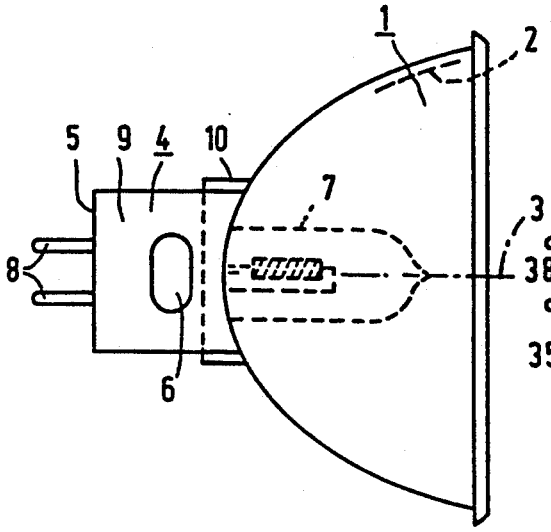
FIG. 1 is a first embodiment in side elevation.

In FIG. 1, the lamp/reflector unit has a reflector body 1, which consists in this embodiment of glass, and is provided with a concave reflecting surface 2, which in this embodiment is an interference mirror transparent to IR and has an optical axis 3. The unit has a neck-shaped portion 4 at the reflector body 1 around the optical axis 3 thereof. The neck-shaped portion 4 has a free end 5 and at its outer surface a relief 6, which extends to the optical axis. The relief 6 is formed by a groove. The unit has an electric lamp 7 mounted in the reflector body 1. Contact pins 8 of the lamp project outwards at the free end 5 of the neck-shaped portion 4.

The neck-shaped portion 4 has a first separate part 9, which in the Figure consists of metal and extends from the free end 5 to beyond the relief 6, and a second part 10, which is integral with the reflector body 1. The first part 9 also has a relief 11, which is formed by a groove and extends in the direction of the optical axis 3. The second part 10 lies at least in part within the first part 9. The first part 9 overlaps the second part 10 at the side shown in the side elevation as well as at the opposite side.

The reflector body 1, the electric lamp 7 and the first part 9 of the neck-shaped portion 4 are joined together with lamp cement.

Figure 2:
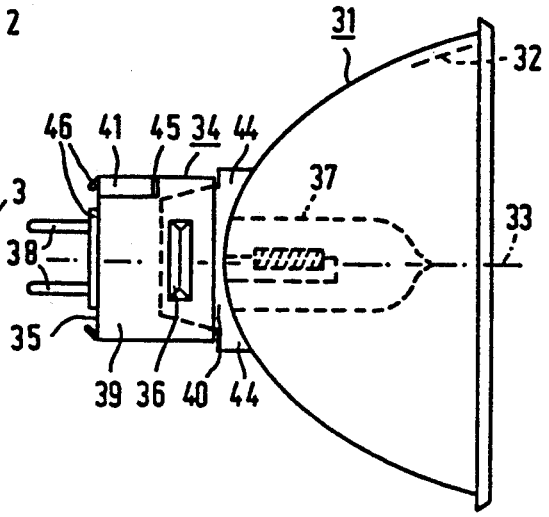
FIG. 2 is a second embodiment in side elevation.
Figure 3:
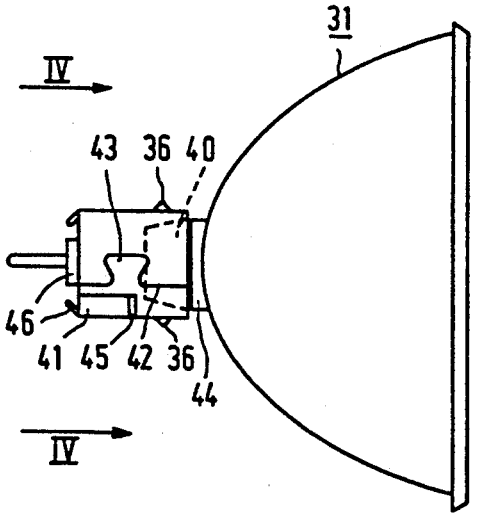
FIG. 3 is the second embodiment rotated through 90°.
Figure 4:
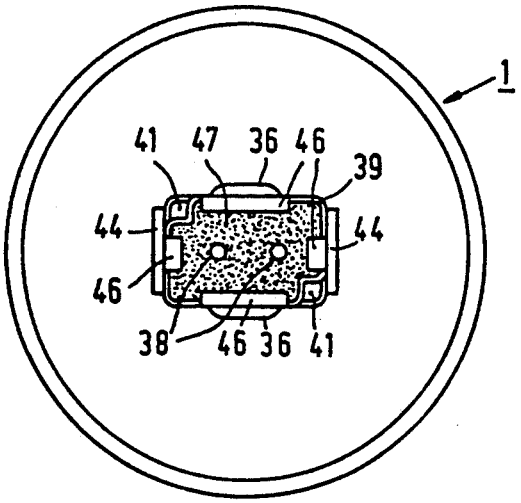
FIG. 4 is the second embodiment viewed in the direction designated IV in FIG. 3.

In FIGS. 2 to 4 corresponding parts have reference numerals which are 30 higher than those in FIG. 1.

The second part 40 of the neck-shaped portion 34 of the lamp/reflector unit is overlapped along its entire periphery by the first, metal, part 39, which has a rectangular cross-section (FIG. 4). The first metal part 39 is made of metal sheet material, for example brass or steel. It has a seam 42 with dovetail closure 43.

The second part 40 of the neck-shaped portion 34 has projections 44, against which the first part 39 is arrested. At corners of the rectangular cross-section the unit has relief 41, which extends in the direction of the optical axis 33. The relief was made in that lateral incisions 45 were provided and the first part 39 was folded inwards from that incision up to the free end 35 (FIG. 4). Inwardly bent tags 46, which make the unit self-centring, are present at the free end 35. The incandescent lamp 37, the glass reflector body 31 and the second part 40 of the neck-shaped portion 34 which is integral with it, and the first part 39 of the neck-shaped portion 34 are joined together with cement 47 (FIG. 4).

We claim:

1. A lamp/reflector unit comprising:

a. a reflector body provided with a concave reflecting surface having an optical axis;

b. a neck-shaped portion at the reflector body disposed around the optical axis and having a free end for attachment to a holder for holding the unit; and c. an electric lamp mounted in the reflector body, said lamp having contact pins extending from said free end for making electrical contact with the holder;

characterized in that the neck-shaped portion includes:

(1) an integral part which is an integral portion of the reflector body; and (2) a separate part which at least partly surrounds and is affixed to the integral part, said separate part including a relief extending transversely to the optical axis for facilitating clamping of the neck-shaped portion to the holder, said separate part, said integral part, and said lamp being joined together by means of cement.

2. A lamp/reflector unit as in claim 1 where the separate part includes a relief extending in the direction of the optical axis for preventing attachment of the neck shaped portion to a different holder than the holder for which it is intended.

3. A lamp/reflector unit as in claim 1 where the separate part includes a relief extending in the direction of the optical axis for preventing attachment of the neck shaped portion to a different holder than the holder for which it is intended.

4. A lamp/reflector unit as in claim 1 where the integral part includes projections against which the separate part is arrested.

5. A lamp/reflector unit as in claim 1 where the integral part includes projections against which the separate part is arrested.

6. A lamp/reflector unit as in claim 1 where the separate part comprises a bent sheet metal part having a seam defining a dovetail closure for attaching adjacent ends of said part of each other.

7. A lamp/reflector unit as in claim 6 where the sheet metal part has a generally rectangular cross section and includes a relief extending in the direction of the optical axis for preventing insertion of the neck shaped portion in a different holder than the holder for which it is intended, said relief being formed by an inwardly folded corner of the sheet metal part.

8. A lamp/reflector unit as in claim 6 where the sheet metal part includes inwardly bent tags at the free end of the neck shaped portion for facilitating centering of said portion in the holder.

9. A lamp/reflector unit as in claim 1 where the separate part comprises a bent sheet metal part having a seam defining a dovetail closure for attaching adjacent ends of said part to each other.

10. A lamp/reflector unit as in claim 9 where the sheet metal part has a generally rectangular cross section and includes a relief extending in the direction of the optical axis for preventing insertion of the neck shaped portion in a different holder than the holder for which it is intended, said relief being formed by an inwardly folded corner of the sheet metal part.

11. A lamp/reflector unit as in claim 10 where the sheet metal part includes inwardly bent tags at the free end of the neck shaped portion for facilitating centering of said portion in the holder.

* * * * *